US006182389B1

(12) United States Patent
Lewis

(10) Patent No.: US 6,182,389 B1
(45) Date of Patent: Feb. 6, 2001

(54) BOLT ASSEMBLY FOR A FIREARM

(76) Inventor: Karl R. Lewis, 6 Timberwood Ct., Moline, IL (US) 61265

( * ) Notice: Under 35 U.S.C. 154(b), the term of this patent shall be extended for 0 days.

(21) Appl. No.: 09/187,953

(22) Filed: Nov. 6, 1998

(51) Int. Cl.[7] ..... F41A 3/00; F41A 7/00
(52) U.S. Cl. ..... 42/16; 89/185
(58) Field of Search ..... 42/25, 16; 89/185

(56) References Cited

U.S. PATENT DOCUMENTS

| | | | | |
|---|---|---|---|---|
| 2,481,548 | | 9/1949 | Waltke, Jr. | 89/162 |
| 2,484,444 | * | 10/1949 | Benson | 42/25 |
| 2,950,653 | * | 8/1960 | Harvey | 89/185 |
| 2,951,424 | | 9/1960 | Stoner | 89/191 |
| 3,507,187 | | 4/1970 | Maillard | 89/185 |
| 3,690,218 | | 9/1972 | Maillard | 89/185 |
| 3,742,638 | * | 7/1973 | Archer | 42/25 |
| 3,979,849 | * | 9/1976 | Haskins | 42/16 |
| 4,058,922 | * | 11/1977 | Elbe et al. | 42/16 |
| 4,272,902 | * | 6/1981 | Waters | 42/25 |
| 4,433,610 | | 2/1984 | Tatro | 89/148 |
| 4,653,210 | * | 3/1987 | Poff | 42/16 |
| 4,655,118 | * | 4/1987 | Bruderer et al. | 89/185 |
| 5,351,598 | * | 10/1994 | Schuetz | 89/185 |
| 5,911,173 | * | 6/1999 | Westrom | 89/185 |
| 5,974,716 | * | 11/1999 | Kidd | 42/25 |

OTHER PUBLICATIONS

One page color printout of a photo showing a perspective end view of a bolt for a 20mm 1939 Lahti and a bottom perspective view of an extractor for the bolt removed therefrom with a quarter placed between the bolt and extractor for dimensional reference.

One page color printout of a photo showing a perspective end view of a bolt for a 20mm 1939 Lahti and a side perspective view of and extractor for the bolt removed therefrom with a quarter placed between the bolt and extractor for dimensional reference.

* cited by examiner

*Primary Examiner*—Charles T. Jordan
*Assistant Examiner*—Michelle Thomson
(74) *Attorney, Agent, or Firm*—Woodard, Emhardt, Naughton, Moriarty & McNett

(57) ABSTRACT

An improved bolt carrier for a firearm is provided that improves the overall reliability and performance of the firearm bolt assembly. The bolt carrier includes a bolt with a body having a number of lugs extending therefrom. The lugs are integrally connected to the body and define a fillet extending between a sidewall of the lug and the outer surface of the body of the bolt. The bolt also includes an extractor pivotably engaged in a recess formed in the bolt. The extractor has a pair of flanges configured to engage a pair of springs disposed on either side of a firing pin bore extending through the bolt.

35 Claims, 7 Drawing Sheets

BOLT ASSEMBLY FOR A FIREARM

FIELD OF THE INVENTION

The present invention relates to firearm bolt assemblies, and more particularly to the improved design of a bolt and extractor for use therewith.

BACKGROUND OF THE INVENTION

The use of automatic and semi-automatic rifles is commonly known to be prevalent in the military. The standard automatic weapon for the U. S. Military is the M- 16 automatic rifle. The M-16 rifle or other weapons related thereto, such as the Stoner 63 or AR10, for example, are also commonly used by militaries of other countries and in the civilian sector. The structure and mechanisms of these weapons, and improvements and variations thereto, have been the subject of many patents over the years.

Generally, the M-16 family of automatic and semi-automatic rifles is based on a gas-operated bolt carrier system. The bolt carrier system includes a multi-lug bolt that interlocks with a barrel extension engaged to the rifle barrel for firing each round of ammunition. The bolt also includes a spring-loaded extractor configured to releasably engage a cartridge as it is placed in the firing chamber. When the rifle is fired, the interlocked bolt receives the recoil force that is transmitted from the face of the bolt to its lugs. The lugs in turn transmit the recoil force to corresponding lugs of the barrel extension. Once the round is fired, the bolt unlocks from the barrel extension and the bolt carrier recoils. As it recoils, the extractor pulls the expended cartridge from the firing chamber. The cartridge is then ejected, as is well known in the art, to allow chambering of another round by the bolt assembly. This process may then be repeated as often as desired by the shooter until the last cartridge is expended.

The design of the bolt carrier and bolts used in such weapons has been the subject of previous patents. For example, U.S. Pat. No. 4,398,448 to LaFever discloses a new design for a bolt carrier which buffers the bolt and bolt carrier upon recoil. The buffer simultaneously stops the rearward motion of the bolt and bolt carrier, thus reducing loading on the cam pins and the latch.

U.S. Pat. No. 5,351,598 to Schuetz also discloses a new type of bolt for an automatic weapon. A portion of some of the lugs on the front face of the bolt have been removed to allow easier chambering of short, low pressure pistol cartridges in an M-16 rifle.

While the prior art has addressed some of the deficiencies in the design of bolts and bolt carriers of automatic and semi-automatic rifles, there still exists many problems in the use of such assemblies. It is well known that the bolts are subject to failure due to the extreme stresses and temperatures to which they are subjected. This problem is particularly focused with respect to the lugs projecting from the main body of the bolt. As described above, the lugs are used to transfer the force from the firing of the cartridge to the barrel of the rifle. This problem is exacerbated further by the fact that automatic and semi-automatic rifles employ an unsymmetrical locking system in order to accommodate the extractor. The lack of symmetry of the load bearing portion of the bolt results in an uneven stress distribution among the lugs. Thus, the lugs of bolts for rifles are subject to structural failure due to the repeated high stresses induced by firing the rifle. This situation creates safety and reliability problems for the user of the rifle.

Another problem known in the art involves the extractor that is typically coupled to a bolt of an automatic or semi-automatic rifle. The extractor is known to malfunction, thus causing a jamming of the rifle due to the spent cartridge remaining in the firing chamber. As previously described, the extractor is typically spring-loaded. In the prior art extractors, the spring has a relatively short length due to the small amount of space between the outer surface of the bolt and the firing pin bore defined by the bolt for receiving the firing pin. The short length of the spring makes it much more difficult to control and maintain the tension to ensure it remains at the proper setting.

While the prior art devices attempt to address some of the problems with bolts and bolt carriers for rifles, there are still problems existing in the art requiring a need for a bolt that effectively addresses those problems. The present invention is directed toward providing various improvements to bolt carriers and bolts for automatic and semi-automatic rifles, and addresses the problems and the shortcomings of the prior art in a novel and unobvious way.

SUMMARY OF THE INVENTION

The present invention addresses the foregoing shortcomings in the design of bolt carriers and bolts for automatic and semi-automatic rifles. In accordance with one aspect of the present invention, a bolt for a firearm includes an elongated body having a proximal end and an opposite distal end along a longitudinal axis. The body defines an intermediate portion having an outer surface. A number of bolt lugs are integrally connected to the outer surface of the intermediate portion and extend radially from the body about the longitudinal axis. Each of the bolt lugs has an end face adjacent the distal end of the body and an opposite bearing face. Each lug also has a pair of sidewalls extending between the end face and the bearing face. At least one of the bolt lugs defines a fillet at the intersection of the sidewall and the outer surface of the cylindrical body.

In accordance with another aspect of the present invention, the bolt includes an elongate body having a proximal end and an opposite distal end along a longitudinal axis. The body defines a generally cylindrical body portion having an outer surface and a firing pin bore extending between the proximal and distal ends. The body further includes a number of bolt lugs positioned adjacent the distal end integrally connected to the body. The bolt lugs radially extend from the body about the longitudinal axis. The bolt lugs include at least a first bolt lug and an adjacent second bolt lug. A recess is formed in the body, and the body defines a pair of spring wells oppositely disposed about the firing pin bore in the recess. A spring is disposed within each of the spring wells, and an extractor is configured to reside in the recess and be pivotably coupled to the body. The extractor includes a first portion extending between the first and second bolt lugs, and an extractor body extending to a second portion. The second portion of the extractor body has a pair of flanges extending therefrom. Each of the flanges engages a corresponding one of the springs to bias the extractor to a first position to releasably engage a cartridge.

In yet another aspect of the present invention, an extractor for a bolt of a firearm is provided. The bolt includes an elongate body having a proximal end and an opposite distal end along a longitudinal axis. The body defines a generally cylindrical portion and a firing pin bore along the longitudinal axis between the proximal and distal ends. The body further includes a number of bolt lugs adjacent to the distal end integrally connected to and radially extending from the body about the longitudinal axis. The bolt lugs include at least a first bolt lug and an adjacent second bolt lug. The body further defines a recess extending between the first and second bolt lugs and a pair of spring wells oppositely disposed about the firing pin bore in communication with the recess. A spring is disposed within each of the spring wells. The extractor includes a first portion extending between the first and second bolt lugs, a pair of flanges extending from a second portion, and a body extending between the first portion and the second portion. A pin pivotably couples the extractor to the body such that each of the flanges engages a corresponding one of the springs. The springs bias the extractor to a first position for releasably engaging a cartridge.

In another aspect of the present invention, a bolt carrier for a firearm is provided. The bolt carrier comprises a bolt defining a firing pin bore therethrough and an extractor pivotably coupled to the bolt. A pair of flanges extend from the extractor. The flanges engage a corresponding spring positioned on opposite sides of the firing pin bore within the bolt.

In another aspect of the present invention, a bolt carrier for a firearm is provided that includes a bolt having firing pin bore extending therethrough. A spring well is defined by the bolt adjacent the firing pin bore. The spring well extends within said bolt to a spring bearing surface positioned proximate or beyond the firing pin bore.

It is one object of the present invention to provide an improved extractor for a bolt used in a firearm that reduces or prevents extractor failures.

It is another object of the present invention to provide an improved lug design for a bolt of a bolt carrier that reduces or prevents structural failure of the bolt.

It is yet another object of the present invention to provide a reliable and safe design of a bolt and bolt carrier used with a firearm.

These and other objects of the present invention will be more apparent from the following description of the figures and preferred embodiments.

BRIEF DESCRIPTION OF TFHE DRAWINGS

DESCRIPTION OF THE PREFERRED EMBODIMENTS

Figure 1:
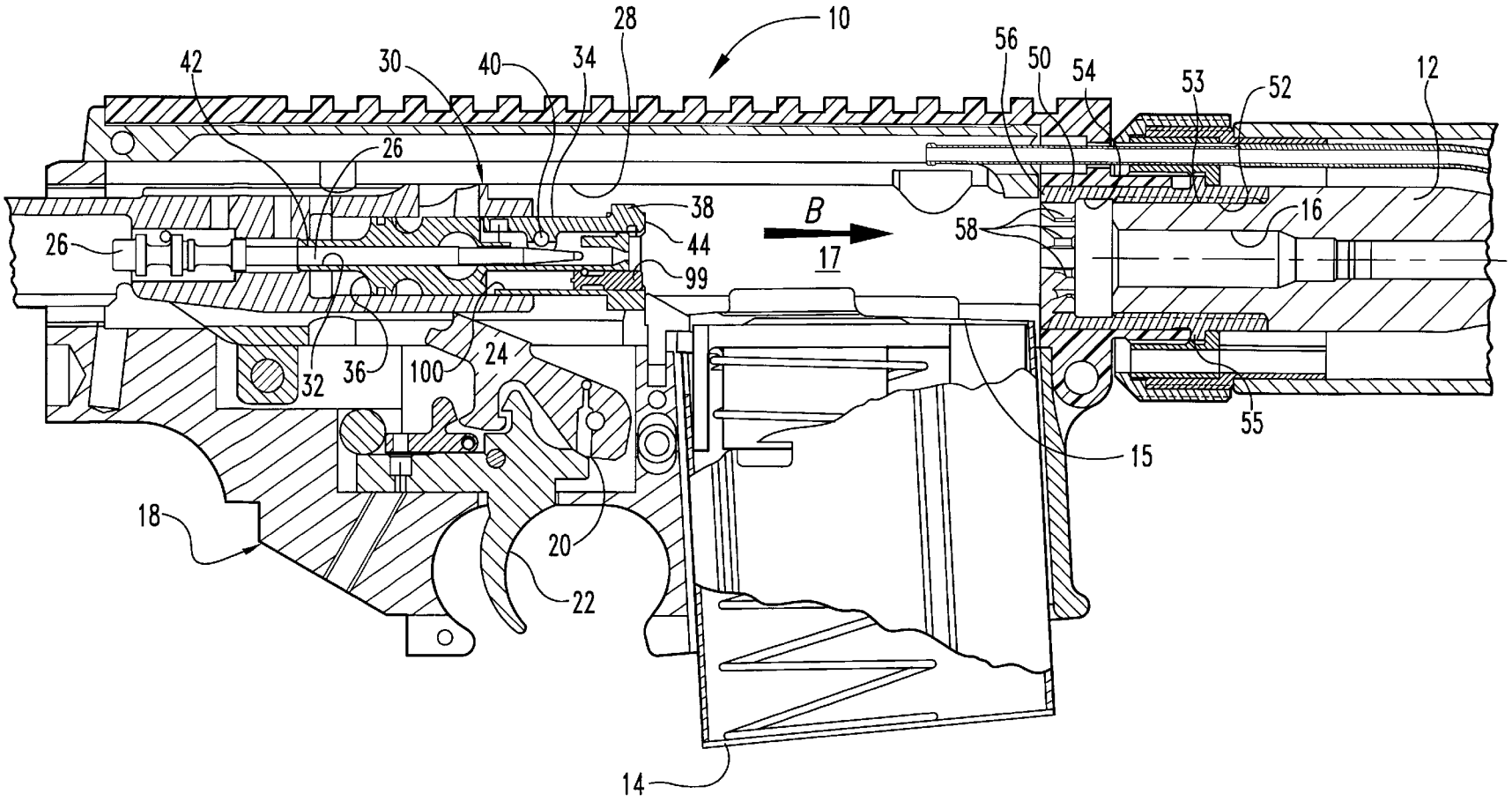
FIG. 1 is a diagrammatic cross-sectional side view of one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A firearm according to one embodiment of the present invention is depicted in FIG. 1 and designated generally at 10. Firearm 10 has barrel 12 and magazine 14. Magazine 14 is configured, as is well-known in the art, to feed cartridges (not shown) to cartridge chamber 17 through cartridge chamber interface 15. Cartridge chamber 17 is defined by receiver 18. Receiver 18 includes trigger assembly 20 with spring-loaded trigger 22, spring-loaded hammer 24, and firing pin 26. Receiver 18 defines cavity 28 configured to house bolt carrier 30. Bolt carrier 30 includes a bolt 36 residing therein. Bolt 36 defines firing pin bore 32 for receiving firing pin 26 therethrough. Bolt 36 additionally defines ejector shaft 100 for receiving cartridge ejector pin 99 therein. Bolt 36 also includes spring-loaded extractor 34 pivotably coupled thereto. Extractor 34 has guide flange 38 and is pivotably coupled by pivot pin 40 to bolt 36. Barrel 12 is coupled to barrel extension 50. Barrel extension 50 defines firing chamber 16 therein for receiving a cartridge chambered by bolt carrier 30.

Figure 2:
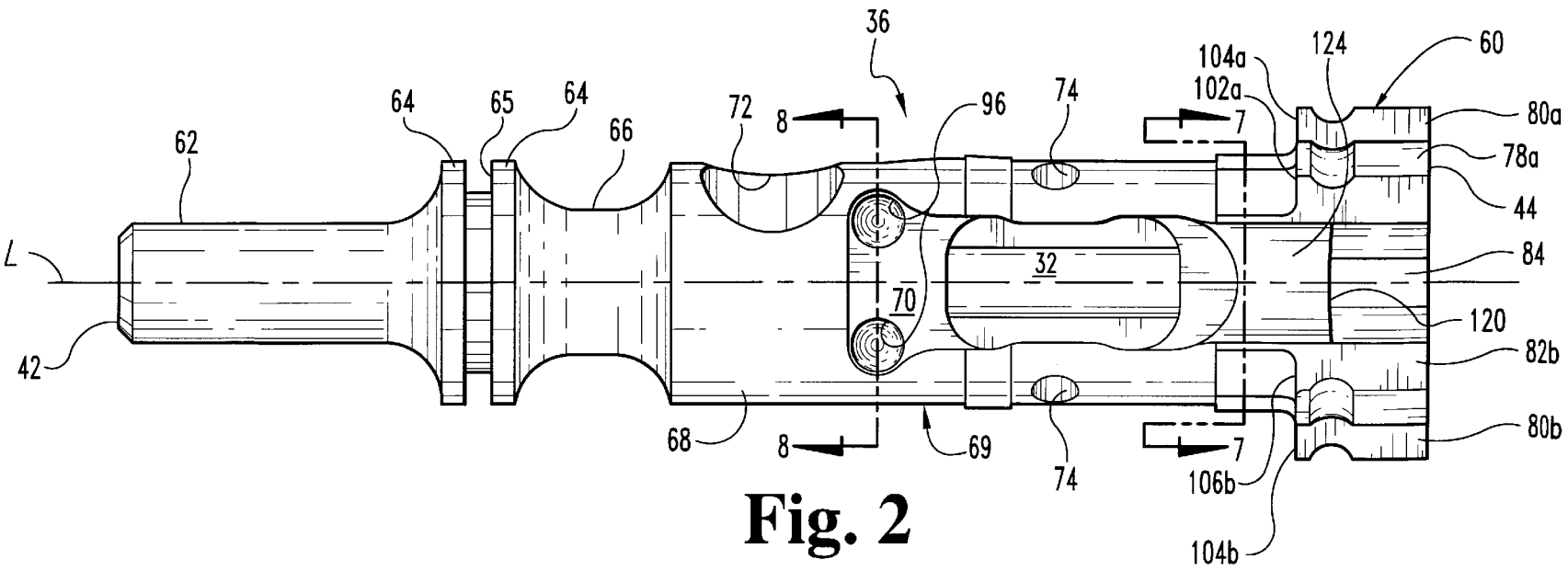
FIG. 2 is a top view of the bolt of the embodiment depicted in FIG. 1.

Referring now to FIG. 2, further description of bolt 36, shown removed from bolt carrier 30, will be provided. Bolt 36 defines an elongate body having a proximal end 42 and an opposite distal end 44 along longitudinal axis L. Bolt 36 includes integrally formed stem 62 adjacent proximal end 42. Circumferential flanges 64 are integrally formed with stem 62. The flanges 64 form a groove 65 therebetween for receiving a sealing ring (not shown). Bolt 36 is also formed with a neck portion 66 extending from the flanges 64 to cylindrical body portion 68. Cylindrical body portion 68 defines first bore 72 therethrough and pin bores 74. Cylindrical body portion 68 also defines an outer surface 69 thereabout and a cartridge bearing surface 120 at distal end 44.

Bolt 36 has a lug portion 60 integrally connected to outer surface 69 adjacent distal end 44. Body portion 68 of bolt 36 also defines extractor recess 70. Extractor recess 70 is in communication with firing pin bore 32 and outer surface 69, and is configured to receive extractor 34 therein. An extractor bearing portion 124 resides within extractor recess 70 adjacent distal end 44 and is integrally formed with body portion 68. Extractor bearing portion 124 is configured to engage a bottom surface 122 (see FIG. 3) of extractor 34. In a preferred embodiment, extractor bearing portion 124 includes a mating surface 126 (see FIG. 7) defining a curved plane substantially parallel to the outer surface 69 of the bolt 36. The bottom surface 122 of extractor 34 is also curved so that it engages bearing portion 124 in form fitting engagement. In another embodiment, bottom surface 122 and mating surface 126 define a substantially flat plane.

Figure 4:
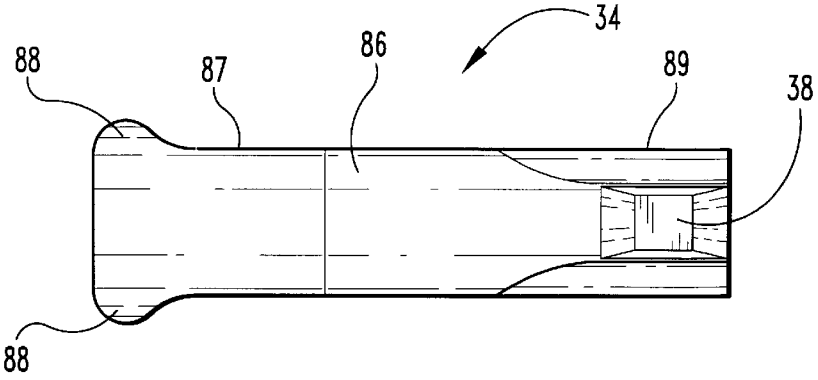
FIG. 4 is a top view of the extractor depicted in FIG. 3.
Figure 3:
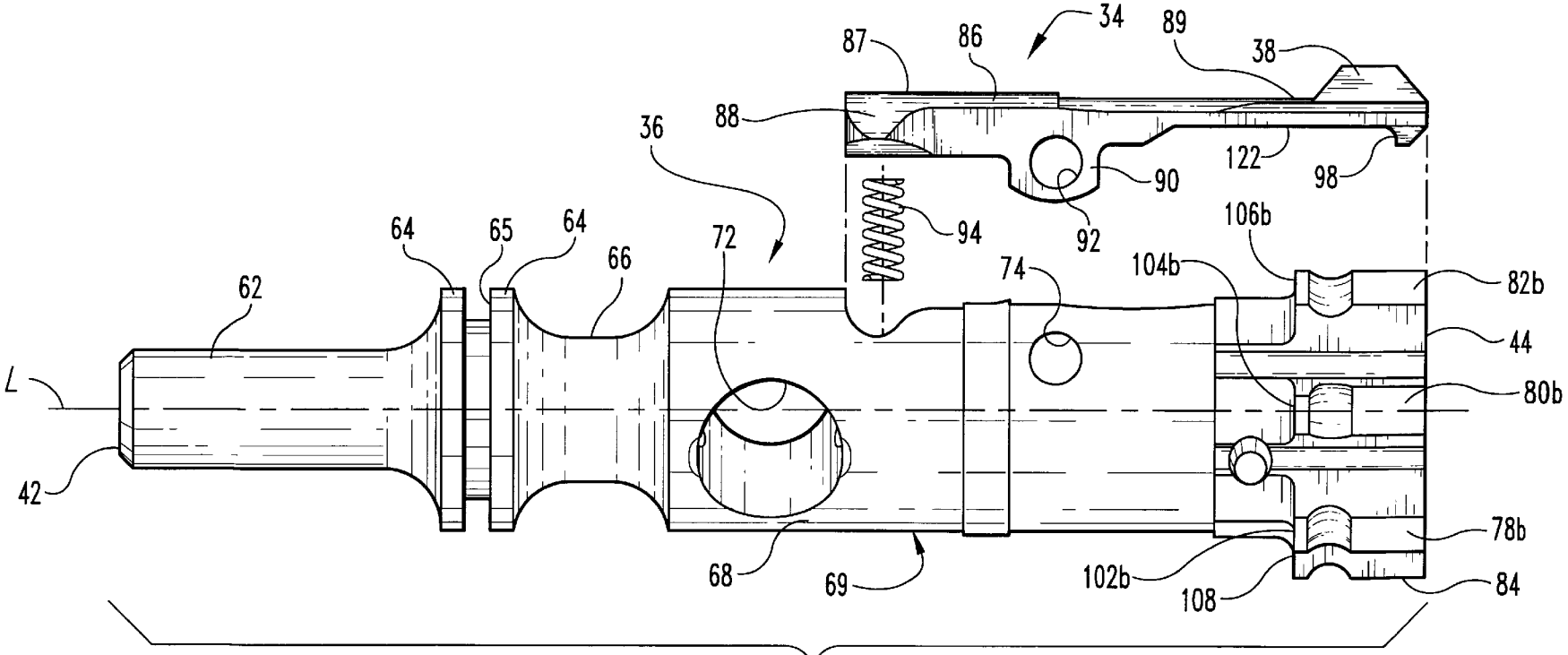
FIG. 3 is a side view of the bolt depicted in FIG. 2 with an exploded view of an extractor configured to reside therein.
Figure 5:
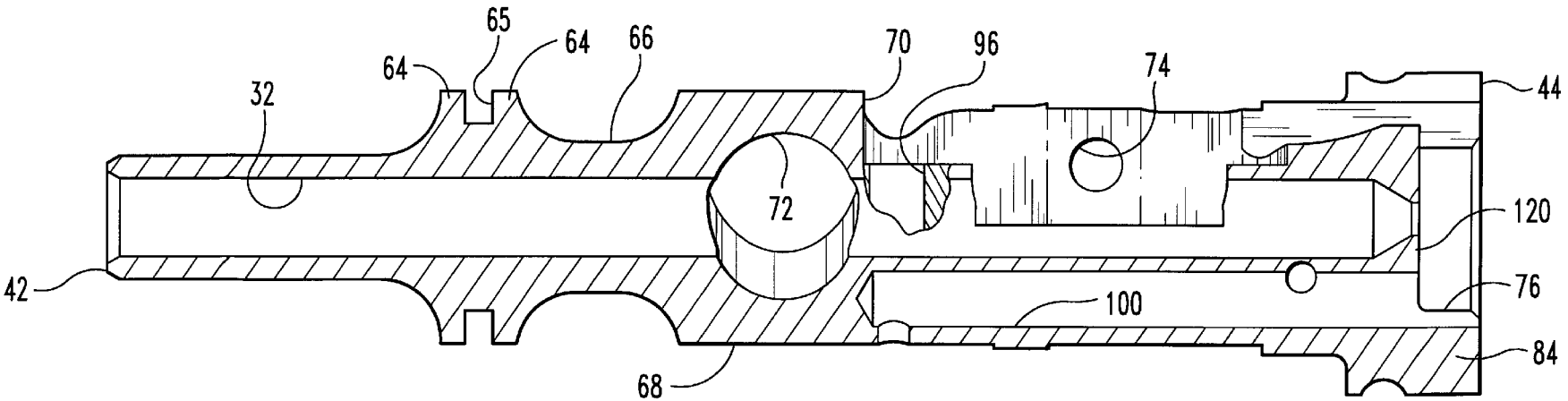
FIG. 5 is a partial cross-sectional side view of the bolt depicted in FIG. 3.

Referring now to FIGS. 3 and 4, extractor 34 includes a guide flange 38 at first portion 89, extractor flanges 88 at second portion 87, and an extractor body 86 extending therebetween. Extractor recess 70 is positioned on cylindrical body portion 68 such that first portion 89 of extractor 34 substantially coincides with distal end 44 of bolt 36. Lip 98 of extractor 34 is then biased in a first position to removably retain a cartridge (not shown) in cartridge recess 76 (see FIG. 5) formed at distal end 44.

Cartridge recess 76 includes cartridge bearing face 120. The retained cartridge resides within cartridge recess 76 such that the end of the cartridge bears against bearing face 120 to transfer the load from firing the cartridge to the bolt 36. Mating surface 126 of cartridge bearing portion 124 defines a portion of the circumference of bearing surface 120.

Preferably, the circumference of bearing surface 120, including the portion defined by mating surface 126, is circular and bearing surface 120 receives the entire circular end portion of the retained cartridge in bearing engagement. In another embodiment, mating surface 126 and bottom surface 122 define a flat plane, and the circular end of the retained cartridge is not fully received in bearing engagement against bearing surface 120. A portion of the end of the cartridge projects above mating surface 126. The preferred embodiment bearing surface reduces and more evenly distributes the stress on the bolt lugs created during firing and extraction of the cartridge. There is also less torque required to be exerted by bolt 36 Extractor 34 also includes pin receiving portion 90 extending therefrom. Pin receiving portion 90 defines extractor bore 92 therethrough. Extractor bore 92 is configured to align with pin bores 74 when extractor 34 is positioned within extractor recess 70. Pivot pin 40 is extended through pin bores 74 and extractor bore 92 to pivotably engage extractor 34 to bolt 36.

Referring back to FIG. 2, extractor recess 70 is provided with a pair of spring wells 96. Spring wells 96 are formed in body portion 68 on opposite sides of firing pin bore 32. Spring wells 96 are each configured to receive an extractor spring 94 therein as more clearly illustrated in FIG. 6. When extractor 34 is engaged to bolt 36 as described above, each one of the flanges 88 engages a corresponding spring 94 positioned in a spring well 96. The springs 94 are configured to pivotably bias extractor 34 radially inward to allow lip 98 to engage the rim of a cartridge. However, springs 94 must have the requisite flexibility to allow movement of extractor lip 98 radially outward to eject a cartridge.

Figure 6:
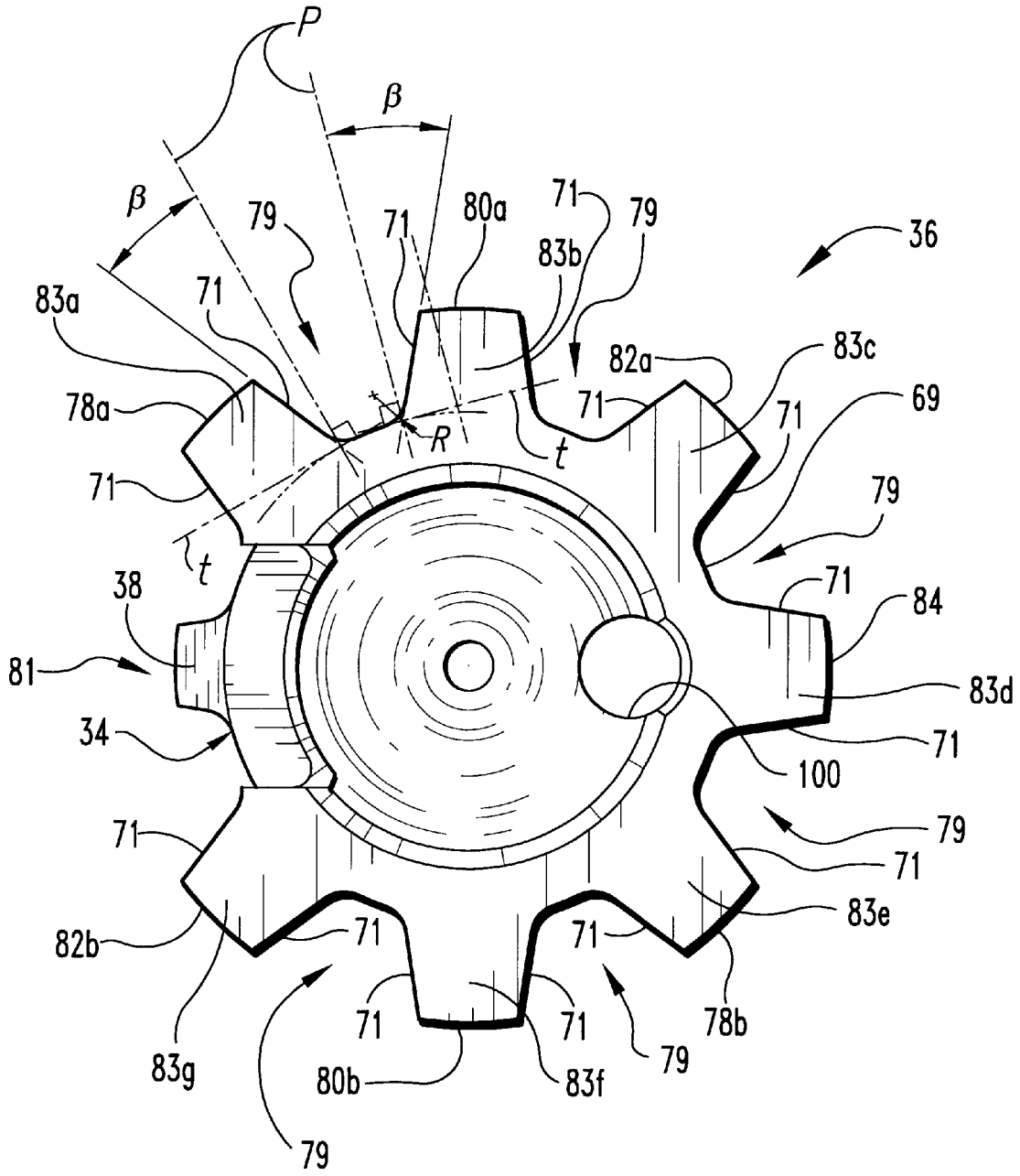
FIG. 6 is an end view of the bolt depicted in FIG. 2 with the extractor depicted in FIG. 4 engaged thereto.

Referring now to FIG. 6, lug portion 60 includes a number of bolt lugs 78*a*, 78*b*; 80*a*, 80*b*; 82*a*, 82*b*; and 84. Each bolt lug radially extends about longitudinal axis L. Lugs 78*a*, 78*b* are collectively designated as lug pair 78 and extend opposite each other. Lugs 80*a*, 80*b* are designated as lug pair 80 and extend radially opposite each other. Finally, lug pairs 82*a*, 82*b* are designated as lug pair 82 and likewise extend radially opposite each other. Bolt lug 84 has no paired lug and extends radially opposite extractor 34, which is positioned between adjacent first lug 78*a* and second lug 82*b*.

Figure 7:
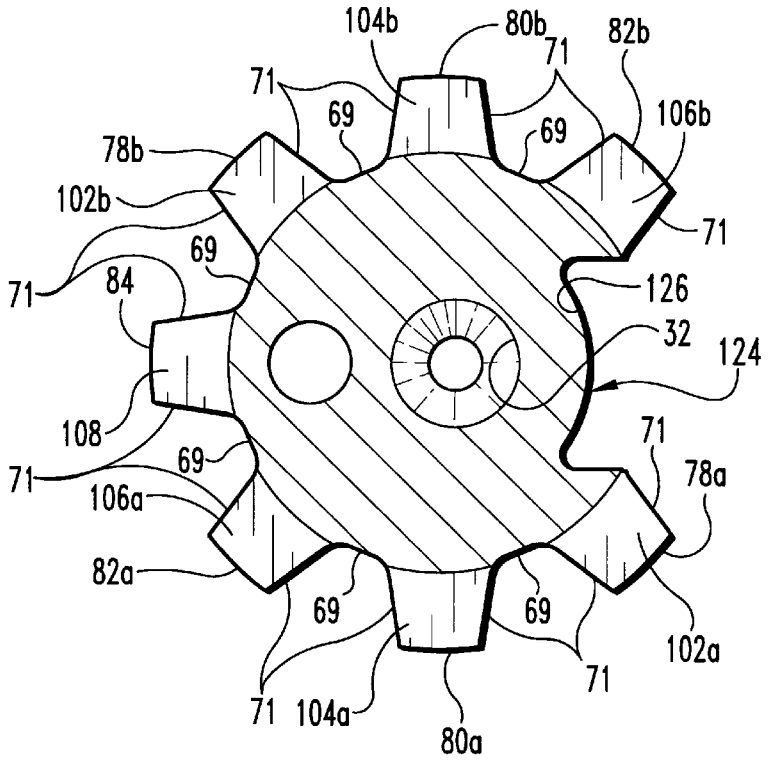
FIG. 7 is a cross-sectional view of the bolt taken along the section line 7—7 as depicted in FIG. 2.

Each adjacent pair of bolt lugs defines a gap 79 therebetween. The first lug 78*a* and the second lug 82*b* are adjacent to one another and define an extractor gap 81. Extractor gap 81 is configured to receive the first portion 89 of extractor 34. Each lug 78*a*, 80*a*, 82*a*, 84, 78*b*, 80*b*, and 82*b* defines a corresponding end face 83*a*, 83*b*, 83*c*, 83*d*, 83*e*, 83*f* and 83*g* (collectively designated as end face 83), respectively. FIG. 7 depicts the paired lugs 78*a*, 78*b* with corresponding bearing faces 102*a*, 102*b*; paired lugs 80*a*, 80*b* with bearing faces 104*a*, 104*b*; and paired lugs 82*a*, 82*b* with bearing faces 106*a*, 106*b*. Lug 84 has bearing face 108.

Figure 8:
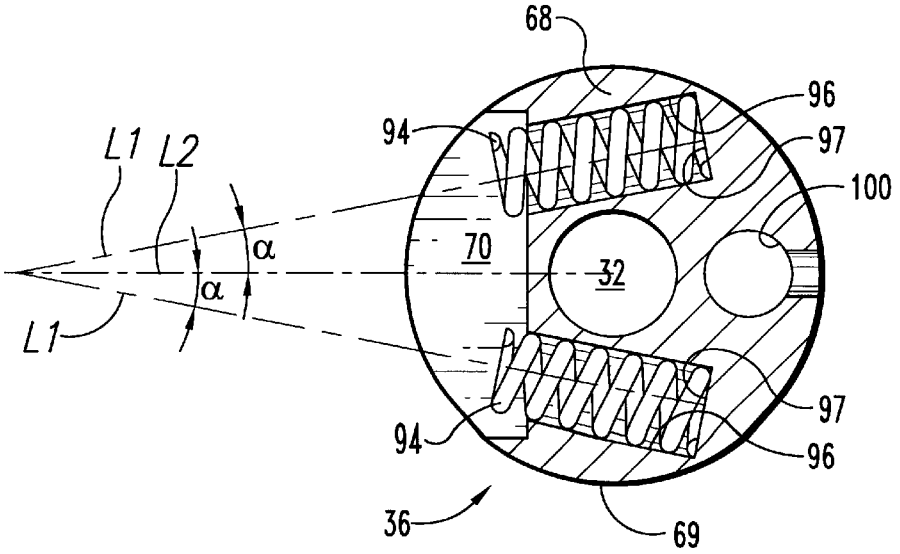
FIG. 8 is a cross-sectional view of the bolt taken along the section line 8—8 as depicted in FIG. 2.

Referring now to FIG. 8, there is illustrated therein a cross-sectional view depicting the relationship between the spring wells 96 and firing pin bore 32. As described above, spring wells 96 are positioned on either side of firing pin bore 32. A spring 94 is positioned in each well 96 and rests on spring bearing surface 97. Each spring well 96 defines a first longitudinal axis L1 extending therethrough. In a preferred embodiment, the first axes L1 diverge as they extend past the firing pin bore 32. The diverging first axes L1 of wells 96 form an angle a with a second axis L2. Second axis L2 is perpendicular to outer surface 69 and extends between the spring wells 96 through the center of firing pin bore 32. In a preferred embodiment, angle $\alpha$ is about 11 degrees. However, it is contemplated herein that angle $\alpha$ may be varied substantially from 11 degrees.

The positioning described above with respect to spring wells 96 within body portion 68 provides many advantages over prior art bolts. For example, positioning a well 96 on each side of the firing pin bore 32 allows bearing surfaces 97 to be positioned at a depth proximate or beyond the position of firing pin bore 32 in cylindrical portion 68. In the prior art, a single spring well 96 is positioned such that the spring bearing surface 97 is located between outer surface 68 and the firing pin bore 32. Thus, the present invention allows the placement of multiple springs 94 with greater length in the spring wells 96. The angular orientation of first axes L1 diverging as they extend past the firing pin bore 32 additionally increases the depth of spring well 96 and accordingly the length of spring 94. The orientation of the first axes L1 with respect to the second axis L2 allows the biasing force from the springs 94 on the extractor 34 to be applied closer to the axis L1, thus reducing the likelihood of uneven loading on the extractor flanges 88.

In an alternate embodiment of the present invention, a single spring well 96 is positioned adjacent firing pin bore 32. Thus, a single spring 94 having a length greater than prior art springs could be used to bias the extractor 34. However, it is preferred to provide at least two spring wells 96 so that the biasing of extractor 34 is concentric about longitudinal axis L of bolt 36. The present invention additionally contemplates providing more than two spring wells adjacent firing pin bore 32, so long as the principles of the present invention are met.

Figure 9:
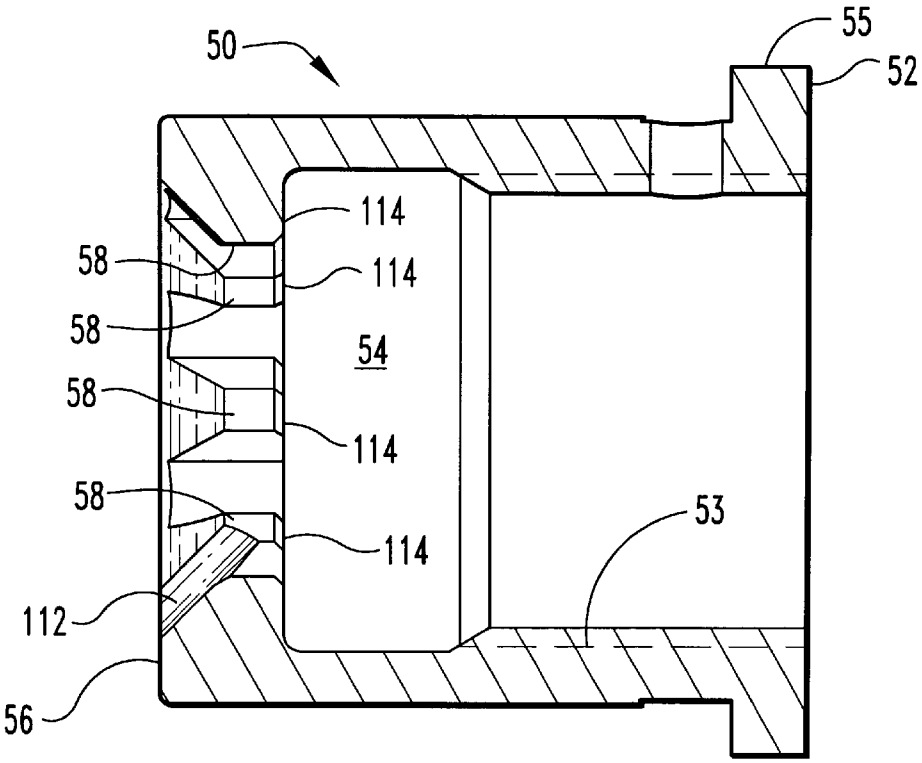
FIG. 9 is a cross-sectional side view of the barrel extension of the embodiment depicted in FIG. 1.
Figure 10:
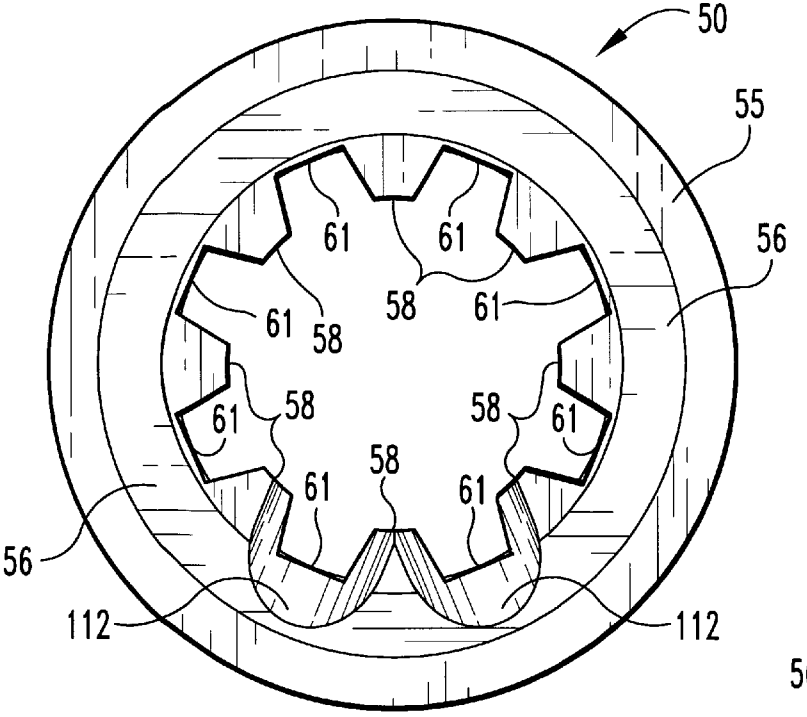
FIG. 10 is an end view of the barrel interface depicted in FIG. 9.

Receiver 18 also includes barrel extension 50 as illustrated in FIGS. 1 and 9–10. Barrel extension 50 is configured to interlock with lug portion 60 of bolt assembly 30 during firing of the firearm. Barrel extension 50 includes barrel receiving end 52 opposite bolt receiving end 56. Adjacent barrel receiving end 52 is connecting portion 53, which is configured to engage barrel 12 as is known in the art. Outer flange 55 protrudes from barrel extension 50 about connecting portion 53. Bolt interlocking chamber 54 is positioned between bolt receiving end 56 and barrel receiving end 52.

Bolt receiving end 56 includes extension lugs 58. Extension lugs 58 define receiving gaps 61 therebetween. Feed ramp 112 is defined proximate a pair of adjacent extension lugs 58 to facilitate insertion of a cartridge and lug portion 60 through bolt receiving end 56. Each receiving lug 60 defines an interlock face 114. Interlock faces 114 engages a corresponding one of lug bearing face 102*a*, 102*b*, 104*a*, 104*b*, 106*a*, 106*b* and 108. It should be noted that the interlock face 114 corresponding to the location of extractor 34 does not bear upon the extractor guide flange 38.

In operation, bolt carrier 30 is driven in a reciprocal manner along longitudinal axis L when rounds are fired from barrel 12. This operation is well-known in the art. Generally, the operation begins with a cartridge from magazine 14 being fed into cartridge recess 76 while bolt 36 is in the open position, as shown in FIG. 1. Bolt 36 then slides forward in the direction indicated by arrow B to position the cartridge in firing chamber 16. As bolt 36 moves forward, the lug pairs 78, 80, 82, and lug 84 of lug portion 60 pass by the extension lugs 58 of barrel extension 50 in interdigiting fashion through receiving gaps 61. Likewise, guide flange 38 passes through a receiving gap 61. Simultaneously, extension lugs 58 pass through a corresponding gap 79 or 81 of lug portion 60.

After the lugs of bolt 36 and barrel extension 50 have passed in interdigiting fashion, bolt carrier 30 continues to move in the direction of arrow B, causing the bolt 36 to rotate about axis L and interlock the bolt 36 in a closed position. Lug portion 60 rotates in interlock chamber 54 of barrel extension 50 as is well known in the art, causing bearing faces 102*a*, 102*b*, 104*a*, 104*b*, 106*a*, 106*b* and 108 to engage a corresponding one of the interlock faces 114. Guide flange 38 of extractor 34 is offset from the interlock faces 114 so that no contact is made therebetween. Once the bolt 36 is interlocked with barrel extension 50, the cartridge in firing chamber 16 may be fired by pulling trigger 22. The pulling motion on trigger 22 rotates the hammer 24 from an engaged cocked position, as shown in FIG. 1, to an unengaged position. Hammer 24 rotates to strike firing pin 26. Firing pin 26 moves within firing pin bore 32 of bolt 36 to strike the cartridge in firing chamber 16, causing the cartridge to fire.

After firing a cartridge, bolt 36 is rotated to unlock from barrel extension 50 and bolt carrier 30 recoils back in receiver 18 in a direction opposite arrow B to an open position, as shown in FIG. 1. As the bolt carrier 30 recoils, ejector pin 99 in shaft 100 is driven towards distal end 44 until it engages the spent cartridge held in cartridge recess 76 by lip 98 of extractor 34. The operation of ejector pins is well-known in the art, and will not be discussed in detail herein. The ejector pin 99 ejects the spent cartridge by rotating the cartridge away from cartridge recess 76. The rotation of the cartridge causes extractor 34 to rotate about pivot pin 40 from its first position, compressing springs 94. The extractor 34 rotates sufficiently to disengage lip 98 of extractor 34 from the rim of the cartridge. Once the cartridge is released from lip 98, springs 94 again bias extractor 34 to return to its first position. When the next cartridge is chambered, the extractor 34 again rotates from its biased first position to allow the lip 98 to engage a cartridge and releasably retain it in recess 76. This operation is repeated at the discretion of the shooter to consecutively load and fire cartridges. It should be understood the present invention contemplates the use of other ejector systems known to those skilled in the art.

The firing of a cartridge in firing chamber 16 causes a recoil force in the direction opposite arrow B. Bolt lug pairs 78, 80, 82 and lug 84 bear against a corresponding interlock face 114 extension lugs 58. Thus, a load bearing relationship is formed between lug pairs 78, 80, 82, lug 84 and extension lugs 58. The force from firing the cartridge is transferred from lug portion 60 of the bolt 34 to the extension lugs 58. This force has been known to create large shear stresses at the interface between the bolt lug pairs 78, 80, 82, lug 84, and cylindrical body portion 68. Rapid and/or repeated firing of the cartridges is known to cause fatigue failure of the bolt lugs at this interface. The problem becomes even more severe due to the unsymmetrical pattern created by the lug pairs 78, 80, 82 and unpaired lug 84. The lack of symmetry results in an unbalanced stress distribution among the bolt lugs. As a result, first bolt lug 78*a* and second bolt lug 82*b* share a disproportionate burden of the load.

As shown in FIG. 6, the pair of sidewalls 71 of each lug extend between end faces 83*a*, 83*b*, 83*c*, 83*d*, 83*e*, 83*f*, 83*g*, and bearing faces 102*a*, 104*a*, 106*a*, 108, 102*b*, 104*b*, and 106*b*, respectively. The sidewall 71 forms a fillet at its junction with outer surface 69. In one embodiment, the fillet defines an arc having a radius R. Preferably, radius R is in the range of about 0.026 inches to 0.036 inches. In a most preferred embodiment, radius R is about 0.031 inches. Alternate embodiments contemplate other fillet radii R determined by considering, for example, the radial height of sidewall 71, the diameter of cylindrical body portion 68, the spacing between adjacent bolt lugs, and/or the stress at the lug/bolt interface. In yet another embodiment, the fillet does not define an arc, but rather the fillet defines a diagonal line extending from sidewall 71 to outer surface 69.

In one alternate embodiment, it is contemplated that a fillet is provided only at selected bolt locations, such as at the intersection of the sidewalls 71 of first bolt lug 78*a* and second bolt lug 82*b* with outer surface 69. However, it is preferred to provide all lugs with a fillet.

Preferably, sidewalls 71 project from outer surface 69 of bolt 36 such that the width of each lug in lug pair 78, 80, 84 and unpaired lug 84 is greatest along outer surface 69. An axis P is illustrated in FIG. 6. Axis P extends perependicular to a tangent line t of outer surface 69 formed at the point where each sidewall 71 intersects outer surface 69. Each sidewall 71 of each lug diverges from the axis P to form the angle β as each extends from outer surface 69 to the end of the lug. In a most preferred embodiment, angle β is about 31 degrees. However, other embodiments contemplate other values for angle β, so long as sidewall 71 diverges from axis P as it extends from outer surface 69. In one embodiment, the sidewalls 71 do not diverge from axis P to form an angle β, but extend substantially parallel to or extend along axis P. In yet another embodiment, less than all of the sidewalls 71 diverge from axis P to form an angle β while the remaining sidewalls 71 run parallel to axis P.

It has been found that by altering the engagement and relationship between the sidewall 71 of the bolt lugs and the outer surface 69 of cylindrical body portion 68, the problems associated with bolt fatigue and failure are reduced or eliminated.

The present invention also contemplates bolt lug patterns that vary from the pattern illustrated in FIGS. 2—10. In one embodiment, the bolt 36 is provided with five bolt lugs in lieu of the seven bolt lugs depicted in FIG. 6. Another embodiment contemplates nine bolt lugs. Other embodiments contemplate more or less bolt lugs as would occur to one skilled in the art.

It has also been found that the above-described configuration of extractor 34 and bolt 36 is particularly advantageous. The addition of flanges 88 to extractor 34 allows the springs 94 to be positioned on either side of firing pin bore 32. Referring to FIG. 8, it can be observed addition of flanges 88 to extractor 34 likewise allows the spring bearing surfaces 97 to be positioned at a depth proximate or beyond firing pin bore 32 in cylindrical portion 68 and to diverge as they extend past firing pin bore 32. This provides additional space to lengthen spring bores 96 and allows the springs 94 to have length greater than currently known in the prior art. Prior art bolts utilize a single spring positioned in line with firing pin bore 32 along longitudinal axis L, with a spring bearing surface positioned between the firing pin bore and the outer surface of the bolt. Thus, prior art springs are more susceptible to fatigue failure given their relatively shorter length. Additionally, it is more difficult to control the biasing force exerted by a single, short spring; thus, the present invention provides more reliable operation of the extractor 34.

Preferably, the springs 94, extractor 34 and bolt 36 are manufactured from a metal material suitable for use in firearms using techniques known to those skilled in the art. Furthermore, it is preferred that bolt 36 and extractor 34 be formed from a single, unitary piece of metal; however, in alternate embodiments, bolt 36 and extractor 34 may be made by coupling two or more separate components as would occur to one skilled in the art. Also, it is contemplated that extractor 34, bolt 36, and springs 94 may be formed from different materials suitable for their intended purpose.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A bolt for a firearm, the bolt comprising:

an elongate body having a proximal end and an opposite distal end along a longitudinal axis, said body defining a generally cylindrical portion and a firing pin bore along said longitudinal axis between said proximal and distal ends, said body further including a number of bolt lugs adjacent said distal end integrally connected to and radially extending from said body about said longitudinal axis, said bolt lugs including at least a first bolt lug and an adjacent second bolt lug;

a recess formed in said body extending between said first and second bolt lugs;

said body further defining a pair of spring wells oppositely disposed about said firing pin bore in communication with said recess;

a spring disposed within each of said spring wells; and an extractor residing within said recess pivotably coupled to said body, said extractor including:

a first portion extending between said first and second bolt lugs;

a second portion having a pair of flanges extending therefrom, each of said flanges engaging a corresponding one of said springs to bias said extractor to a first position; and a body extending between said first portion and said second portion.

2. The bolt of claim 1, wherein each of said spring wells includes a spring bearing surface, said spring bearing surface positioned proximate said firing pin bore.

3. The bolt of claim 2, wherein each of said spring bearing surfaces is positioned below said firing pin bore.

4. The bolt of claim 1, wherein said first portion includes a guide flange extending therefrom.

5. The bolt of claim 1, wherein said extractor further includes a pin receiving portion, said pin receiving portion defining a pin bore therethrough for receiving a pivot pin, whereby said pivot pin pivotably couples said extractor to said body.

6. The bolt of claim 1, wherein:

said body includes an extractor bearing portion within said recess adjacent said distal end, said bearing portion including a mating surface, said mating surface defining a curved plane extending substantially parallel to an outer surface of said cylindrical body portion; and said extractor includes a bottom surface configured to engage said mating surface in form fitting relation.

7. The bolt carrier of claim 1, wherein each of said spring wells defines a first axis therethrough, said bolt defines a second axis extending therethrough perpendicular to said firing pin bore and intersecting each of said first axes at a point, each of said first axes forming an acute angle a with said second axis at said point towards said firing pin bore.

8. An extractor for a bolt of a firearm, the bolt including an elongate body having a proximal end and an opposite distal end along a longitudinal axis, the body defining a generally cylindrical portion and a firing pin bore along the longitudinal axis between the proximal and distal ends, the body further including a number of bolt lugs adjacent the distal end integrally connected to and radially extending from the body about the longitudinal axis, the bolt lugs including at least a first bolt lug and an adjacent second bolt lug, the body further including a recess formed therein extending between the first and second bolt lugs, the body additionally defining a pair of spring wells oppositely disposed about the firing pin bore in communication with the recess and spring disposed within each of the spring wells, the extractor comprising:

a first portion extending between the first and second bolt lugs;

a second portion having a pair of flanges extending therefrom;

a body extending between said first portion and said second portion, said body having a pin receiving portion defining a pin bore therethrough; and a pin disposed through said pin bore for pivotably coupling the extractor to the body, wherein each of said flanges engages a corresponding one of the springs to bias the extractor to a first position for releasably engaging a cartridge.

9. The bolt carrier of claim 18, wherein the bolt includes a pair of spring wells, each of the spring wells defining a first axis therethrough, the bolt defining a second axis extending therethrough perpendicular to the firing pin bore and intersecting each of the first axes at a point, each of the first axes forming an acute angle a with the second axis at said point towards said firing pin bore.

10. A bolt carrier for a firearm, the bolt carrier, comprising:

a bolt having a cylindrical body defining a firing pin bore therethrough;

an extractor pivotably coupled to said bolt, said extractor defining a pair of flanges extending therefrom; and a pair of springs oppositely disposed about said firing pin bore within said bolt, wherein each of said flanges engages a corresponding one of said springs.

11. The bolt carrier of claim 10, wherein said body includes an outer surface thereabout and a proximal end and distal end along a longitudinal axis; and a number of lugs extending radially from said body about said longitudinal axis.

12. The bolt carrier of claim 11, wherein each of said number of lugs defines an end face and an oppositely opposed bearing face along said longitudinal axis, each of said lugs further defining a pair of sidewalls extending between said end face and said bearing face.

13. The bolt carrier of claim 12, wherein at least one said lugs defines a fillet formed by the intersection of each said sidewalls and said outer surface.

14. The bolt carrier of claim 13 wherein said fillet defines a diagonal extending between said sidewall and said outer surface.

15. The bolt carrier of claim 13, wherein said fillet defines an arc having a radius R extending between said sidewall and said outer surface.

16. The bolt carrier of claim 15, wherein said radius R is about 0.026 inches to about 0.036 inches.

17. The bolt carrier of claim 15, wherein said radius R is about 0.031 inches.

18. The bolt carrier of claim 10, wherein said bolt includes a pair of spring wells, each of said spring wells defining a first axis therethrough, said bolt defining a second axis extending therethrough perpendicular to said firing pin bore and intersecting each of said first axes at a point, each of said first axes forming an acute angle α with said second axis at said point towards said firing pin bore.

19. A bolt carrier for a firearm, the bolt carrier comprising:

a bolt having a cylindrical body defining firing pin bore therethrough; and at least one spring well defined by said bolt adjacent said firing pin bore, said spring well extending within said bolt in a direction generally transverse to said firing pin bore to a spring bearing surface positioned proximate said firing pin bore.

20. The bolt carrier of claim 19, wherein said at least one spring well extends within said bolt to a spring bearing surface positioned beyond said firing pin bore.

21. The bolt carrier of claim 19, wherein said at least one spring well defines a first axis therethrough and said bolt defines a second axis extending therethrough perpendicular to said firing pin bore through a centerline of an extractor recess formed in said bolt and intersecting said first axis, said first axis forming an acute angle a with said second axis towards said firing pin bore.

22. The bolt carrier of claim 21, wherein said angle a is about 11 degrees.

23. A bolt for a firearm, the bolt comprising:

an elongate body having a proximal end and an opposite distal end along a longitudinal axis, said body defining an intermediate portion between said proximal and distal ends, said intermediate portion having an outer surface thereabout; and a number of bolt lugs adjacent said distal end extending from said outer surface and extending radially from said body about said longitudinal axis, each of said number of bolt lugs having an end face and an opposing bearing face along said longitudinal axis with said end face proximate said distal end, each of said bolt lugs further having a pair of sidewalls extending between said end face and said bearing face, wherein at least one of said bolt lugs includes a pair of fillets formed by the intersection of each of said sidewalls with said outer surface and each of said fillet defines a diagonal extending between said sidewall and said outer surface.

24. The bolt of claim 23, wherein all of said number of lugs include a pair of fillets.

25. The bolt of claim 23, further comprising an extractor pivotably coupled to said body, wherein said number of bolt lugs includes a first bolt lug and an adjacent second bolt lug, and the extractor has a first portion extending between said first and second bolt lugs.

26. The bolt of claim 25, wherein said extractor further includes a second portion opposite said first portion and a body extending between said first and second portions, said second portion having a pair of flanges extending therefrom.—-38.

27. The bolt of claim 26, further comprising:

a pair of spring wells defined by said body; and a spring disposed within each of said spring wells, wherein said flanges are configured to engage a corresponding one of said springs, said springs biasing said extractor to a first position for releasably engaging a cartridge.

28. A bolt for a firearm, the bolt comprising:

an elongate body having a proximal end and an opposite distal end along a longitudinal axis, said body defining an intermediate portion between said proximal and distal ends, said intermediate portion having an outer surface thereabout; and a number of bolt lugs adjacent said distal end extending from said outer surface and extending radially from said body about said longitudinal axis, each of said number of bolt lugs having an end face and an opposing bearing face along said longitudinal axis with said end face proximate said distal end, each of said bolt lugs further having a pair of sidewalls extending between said end face and said bearing face, wherein at least one of said bolt lugs includes a pair of fillets formed by the intersection of each of said sidewalls with said outer surface, further wherein said fillet defines an arc having a radius R of about 0.026 inches to about 0.036 inches extending between said sidewall and said outer surface.

29. The bolt of claim 28, wherein said radius R is about 0.031 inches.

30. The bolt of claim 28, wherein all of said number of lugs includes a pair of fillets.

31. The bolt of claim 28, further comprising an extractor pivotably coupled to said body, wherein said number of bolt lugs includes a first bolt lug and an adjacent second bolt lug, and the extractor has a first portion extending between said first and second bolt lugs.

32. The bolt of claim 31, wherein said extractor further includes a second portion opposite said first portion and a body extending between said first and second portions, said second portion having a pair of flanges extending therefrom.

33. The bolt of claim 32, further comprising:

a pair of spring wells defined by said body; and a spring disposed within each of said spring wells, wherein said flanges are configured to engage a corresponding one of said springs, said springs biasing said extractor to a first position for releasably engaging a cartridge.

34. The bolt of claim 28, wherein at least one sidewall forms an angle B with an axis extending perpendicularly from a tangent, said tangent formed where said at least one sidewall intersects said outer surface.

35. The bolt of claim 34, wherein said angle B is about 31 degrees.

* * * * *